United States Patent [19]

Altman et al.

[11] Patent Number: 4,872,887

[45] Date of Patent: Oct. 10, 1989

[54] METHOD FOR FLUE GAS CONDITIONING WITH THE DECOMPOSITION PRODUCTS OF AMMONIUM SULFATE OR AMMONIUM BISULFATE

[75] Inventors: Ralph F. Altman, Chattanooga, Tenn.; John P. Gooch; Edward B. Dismukes, both of Birmingham, Ala.; Edward C. Landham, Jr., Pinson, Ala.

[73] Assignee: Electric Power Research Institute, Inc., Palo Alto, Calif.

[21] Appl. No.: 243,435

[22] Filed: Sep. 12, 1988

[51] Int. Cl.[4] ..... B03C 1/00

[52] U.S. Cl. ..... 55/5; 423/541 A

[58] Field of Search ..... 55/5, 8; 423/541 A, 423/532, 520

[56] References Cited

U.S. PATENT DOCUMENTS 3,855,386 12/1974 Moore ..... 423/532
4,070,424 1/1978 Olson et al. ..... 55/5
4,081,515 3/1978 Gruhier et al. ..... 423/541 A
4,533,364 8/1985 Altman et al. ..... 55/5

*Primary Examiner*—Bernard Noziok
*Attorney, Agent, or Firm*—Flehr, Hohbach, Test, Albritton & Herbert

[57] ABSTRACT

A method is provided for enhancing the efficiency of fly ash collection in an electrostatic precipitator by lowering the resistivity of the fly ash particles in the flue gas, comprising the steps of introducing an aqueous solution of ammonium sulfate or ammonium bisulfate into a slipstream of hot flue gas or hot combustion air in a chamber external to the main flue gas duct wherein thermal decomposition is effected, removing the $NH_3$ decomposition product by catalytic oxidation to increase the effectiveness of the $SO_3$ decomposition product, and then distributing the $SO_3$ decomposition product into the main flue gas stream exiting from the air preheater at a point upstream from the electrostatic precipitator.

12 Claims, 6 Drawing Sheets

METHOD FOR FLUE GAS CONDITIONING WITH THE DECOMPOSITION PRODUCTS OF AMMONIUM SULFATE OR AMMONIUM BISULFATE

FIELD OF INVENTION

The present invention relates generally to a method for improving the efficiency of fly ash collection in an electrostatic precipitator located on the cold side of the air preheater (cold side precipitator) operating on flue gas from a coal-burning boiler. More specifically, the invention relates to a method for decreasing the electrical resistivity of the fly ash by treatment of the ash with the thermal decomposition products of an aqueous solution of ammonium sulfate or ammonium bisulfate, after catalytic oxidation of the $NH_3$ decomposition product to increase the effectiveness of the $SO_3$ decomposition product.

BACKGROUND OF INVENTION

An electrostaic precipitator is an apparatus used to remove fly ash particles from flue gas in order to reduce atmospheric pollution. The precipitator utilizes a corona discharge to electrically charge the fly ash particles, which are then attracted to a grounded collecting plate. The performance of the precipitator is in part dependent upon the electrical resistivity of the fly ash particles; the performance is most efficient when the resistivity is in the approximate range of $10^9$ to 10 ohm cm. If the resistivity is too high, current flow through the precipitated ash layer on the plate establishes corona in the ash layer, which is detrimental to the precipitation process. Precipitation is impeded by this additional corona (termed "back corona") because the fly ash particles are subjected to bipolar charging at a diminished electric field in the interelectrode space. On the other hand, if the resistivity is too low, the particles collected on the plate are difficult to retain on the plate. As a result, they tend to be reentrained in the flue gas. When a favorable resistivity is achieved, the problems of back corona and re-entrainment are alleviated and there is a resultant increase in the precipitation efficiency.

It is known that the interaction of fly ash with sulfur trioxide enhances the performance of a cold side electrostatic precipitator by lowering the resistivity of the ash particles. Various methods are known for providing sulfur trioxide to flue gas. For example, sulfur trioxide has been provided to the flue gas upstream of the precipitator by coverting sulfur dioxide contained in the flue gas to sulfur trioxide (by means of catalytic oxidation with oxygen, after removal of fly ash, or direct oxidation with ozone), by converting sulfur dioxide from an external source to sulfur trioxide by means of catalytic oxidation with oxygen and introducing the sulfur trioxide into the flue gas, by the addition of the decomposition products of sulfuric acid (water vapor and sulfur trioxide), and by the addition of the vapor of sulfuric acid.

One disadvantage of the known methods is that the system for catalytic oxidation of sulfur dioxide to sulfur trioxide has a much higher capital cost than the system required for the present invention. The method which employs sulfuric acid as a conditioning agent is undesirable because sulfuric acid is highly corrosive.

Still other processes for providing sulfur trioxide to flue gas to enhance electrostatic precipitation involve the addition of sulfur trioxide to the flue gas in combination with ammonia and water, specifically as the decomposition products of the compound ammonium sulfate or ammonium bisulfate. U.S. Pat. No. 3,665,676 describes the addition of a finely divided powder or an aqueous solution of ammonium sulfate or ammonium bisulfate to flue gas upstream from a precipitator and downstream from an air preheater at a temperature in the 240° F. to 800° F. range. A disadvantage of this method is that at this point of injection the upper limit of the temperature range will rarely exceed 400° F., and as a result, the thermal decomposition of the added chemical to produce sulfur trioxide will be minimal. The added ammonium sulfate may not be decomposed much further than the products ammonia and ammonium bisulfate and the added ammonium bisulfate may not be appreciably decomposed at all. With sulfur trioxide remaining in a chemically combined form (ammonium sulfate or ammonium bisulfate), it is less satisfactory than that of the equivalent amount introduced as gaseous decomposition products because either it is required in a greater amount for a given resistivity change or it imparts an undesirable sticky quality to the ash.

U.S. Pat. Nos. 4,042,348 and 4,043,768 describe methods involving the addition of an aqueous solution of ammonium bisulfate (4,042,348) or ammonium sulfate (4,043,768) to the flue gas at a point upstream from the air preheater, where the temperature is between 1094° F. (590° C.) and 1652° F. (900° C.) but preferably not above 1382° F. (750° C.). While U.S. Pat. Nos. 4,042,348 and 4,043,768 disclose that the temperature range of 590° C. to 900° C. is sufficient to bring about the volatilization of the chemicals, which may avoid air preheater pluggage, it is evident that to the degree that gaseous ammonia, water, and sulfur trioxide are produced in the volatilization process, recombination to ammonium bisulfate or ammonium sulfate may still ensue and result in air preheater pluggage.

The invention described and disclosed in U.S. Pat. No. 4,533,364, entitled Method For Flue Gas Conditioning With The Decomposition Products Of Ammonium Sulfate Or Ammonium Bisulfate, which issued Aug. 6, 1985 to Electric Power Research Institute, the assignee of the present application, sought to overcome the problems of the prior art methods by decomposing an aqueous solution of ammonium sulfate or ammonium bisulfate in a slipstream of hot flue gas or hot combustion air having a temperature in the range of about 600° F. to 1000° F. in a chamber external to the main flue gas duct, and then injecting the decomposition products into the main flue gas duct at a point between the air preheater and the electrostatic precipitator (ESP). The $SO_3$ thus produced gives markedly effective improvement in ESP performance at 300° F. (the typical temperature of the flue gas at the inlet to the ESP). The aqueous solution of ammonium sulfate or bisulfate is sprayed into the slipstream of hot flue gas or hot combustion air at a rate sufficient to produce a $SO_3$ concentration in the range of from about 250 to 2500 ppm by volume.

Typically, the $SO_3$ concentration in the slipstream is about 1000 ppm, but it would only be about 10 to 20 ppm in the main gas stream if its concentration were based on dilution alone. Data collected at power plants using this method of flue gas conditioning reveals that much less than 1 ppm of $SO_3$ remains in the gas phase at 300° F. at the inlet to the ESP. The presumption is that $SO_3$ disappears from the gas stream by two competitive processes: (a) absorption by the fly ash and (b) recombination with $NH_3$ and $H_2O$ as ammonium sulfate or bisulfate particulate. The observed improvement in ESP performance seemingly has to signify that the relative rates of the two processes are such that (b) does not nullify (a). Yet if (b) could not occur at all, the benefit of (a) would be greater. The process of the present invention has solved the problem of $SO_3$ recombination with $NH_3$ and $H_2O$, thereby greatly improving the process disclosed in U.S. Pat. No. 4,533,364.

Like the process disclosed in U.S. Pat. No. 4,533,364, the present invention solves the problems of air preheater pluggage caused by injecting aqueous ammonium sulfate or bisulfate into the main flue gas stream upstream from the air preheater, and solves the problems of inadequate thermal decomposition of the ammonium sulfate or ammonium bisulfate when the aqueous solution is injected into the main flue gas downstream of the air preheater where the temperature is typically too low for complete thermal decomposition of the ammonium sulfate or bisulfate. In addition, the process of the present invention greatly improves the process disclosed in U.S. Pat. No. 4,533,364 by solving the problem of recombination of $NH_3$ and $SO_3$ at the lower temperatures in the main flue gas stream where the slipstream of flue gas or hot air containing the decomposition products is re-introduced downstream of the air preheater and directly upstream of the ESP.

The present invention solves the problem of $NH_3$ and $SO_3$ recombination by adding a catalytic element in the lower part of the decomposition chamber to destroy the $NH_3$ gas produced by the decomposition of ammonium sulfate or bisulfate. The removal of the $NH_3$ produces the following possible benefits: (a) elimination of the competition by $NH_3$ for the $SO_3$ at a reduced temperature to allow substantially all of the $SO_3$ to react with fly ash; (b) elimination of a significant amount of $NH_3$ that would otherwise be present in the flue gas; and (c) elimination of $NH_3$ from the fly ash, making the ash more generally acceptable for marketing as a component of cement.

SUMMARY AND OBJECTS OF INVENTION

The present invention provides a method which is advantageous over the prior art methods by the steps of decomposing ammonium sulfate or ammonium bisulfate in a slipstream of hot flue gas or hot combustion air, having a temperature in the range of about 600° F. to 1000° F. in a chamber external to the main flue gas duct, removing the $NH_3$ decomposition product by catalytic oxidation to increase the effectiveness of the $SO_3$ decomposition product, and then injecting the decomposition products into the main flue gas duct at a point between the air preheater and the precipitator.

It is therefore an object of the present invention to provide an improved method of lowering the resistivity of fly ash particles with aqueous ammonium sulfate or ammonium bisulfate solutions.

Another object of the present invention is to eliminate air preheater pluggage by injecting the decomposition products downstream from the air preheater.

A further object of the present invention is to achieve maximum benefit from the ammonium sulfate or ammonium bisulfate by decomposing the compound in an external chamber where the temperature is high enough to ensure a substantial degree of decomposition.

Another object of the present invention is removal of substantially all of the $NH_3$ decomposition product by catalytic oxidation to eliminate the competition by the $NH_3$ for the $SO_3$ decomposition product, thereby allowing substantially all of the $SO_3$ to react with the fly ash.

DETAILED DESCRIPTION OF INVENTION

In accordance with the present invention, there is provided a method comprising the steps of thermally decomposing an aqueous solution of ammonium sulfate or ammonium bisulfate [hereinafter sometimes referred to as the conditioning agent] in a slipstream of hot flue gas or hot combustion air in a chamber external to the main flue gas ducts, removing substantially all of the $NH_3$ decomposition product by catalytic oxidation to increase the effectiveness of the $SO_3$ decomposition product, and distributing the $SO_3$ decomposition product and any other remaining decomposition products into the main stream of flue gas exiting from the air preheater at a point upstream from the electrostatic precipitator.

The thermal decomposition is preferably effected by spraying an aqueous solution of ammonium sulfate or ammonium bisulfate into a chamber external to the main flue gas ducts through which a slipstream of hot flue gas or hot combustion air is flowing. The decomposition products then flow through an ammonia oxidation chamber containing a catalytic system capable of producing the desired oxidation of $NH_3$ with $O_2$ without producing a significant reduction in the concentration of $SO_3$. [It should be noted that the required $O_2$ is normally present in both flue gas and combustion air; no $O_2$ addition is needed.]

Figure 5A:
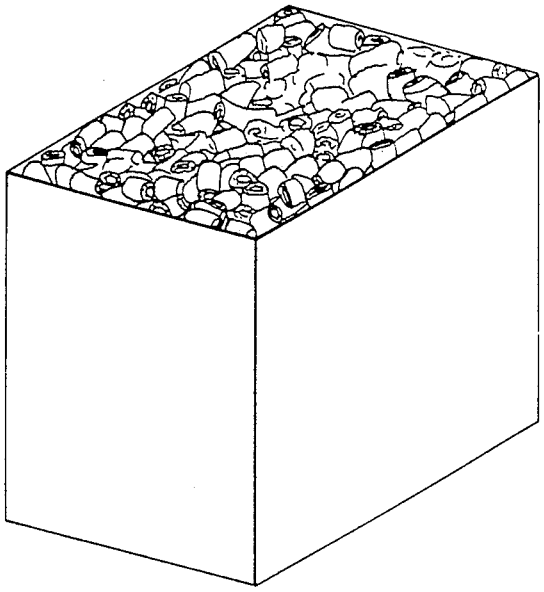
FIG. 5 illustrates a catalyst in the form of pellets which can be used in the ammonia oxidation chamber of the decomposer system.
Figure 5B:
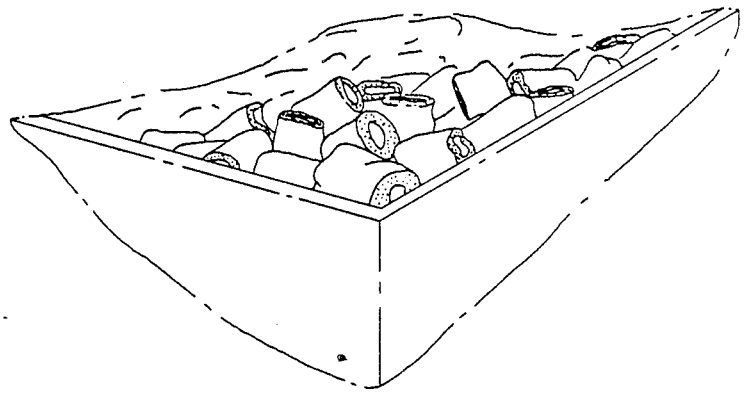
Figure 6A:
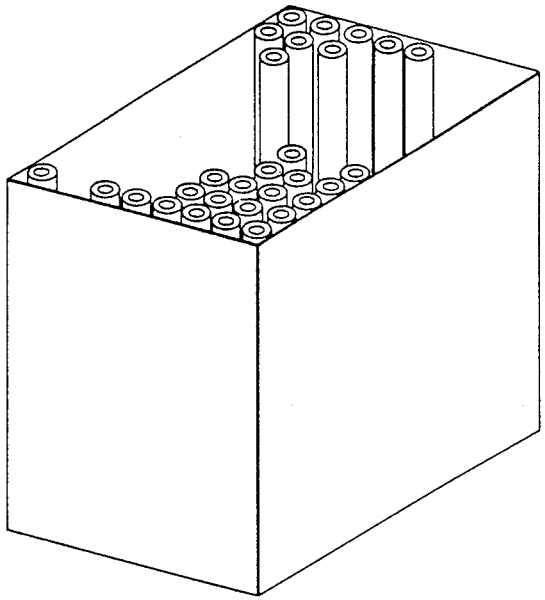
FIG. 6 illustrates a catalyst in the form of hollow tubes which can be used in the ammonia oxidation chamber of the decomposer system.
Figure 6B:
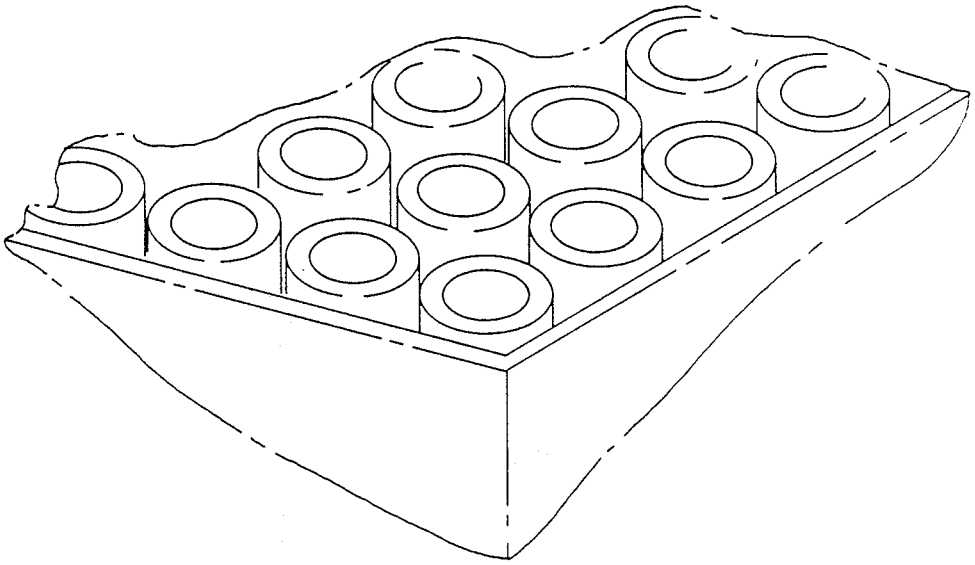
Figure 7A:
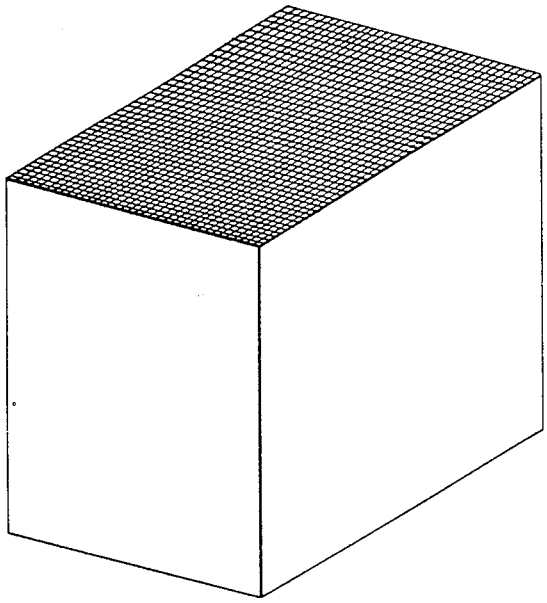
FIG. 7 illustrates a catalyst in a parallel path honeycomb arrangement which can be used in the ammonia oxidation chamber of the decomposer system.
Figure 7B:
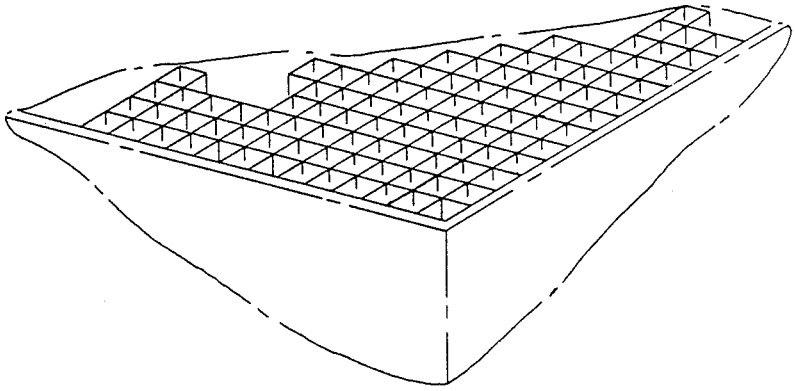

The catalyst can be in the form of pellets as shown in FIG. 5 or hollow tubes as shown in FIG. 6, or can be applied to a parallel-passage support creating a honeycomb arrangement as shown in FIG. 7.

The catalyst in the form of pellets is better suited for the process using hot combustion air to decompose the ammonium sulfate or bisulfate because the spaces between the pellets tend to fill with fly ash when flue gas is used as the decomposer. The hollow tube or parallel path catalysts do not suffer the same disadvantage since the fly ash tends to pass through the tubes or parallel path and therefore does not restrict the gas passages in these types of catalysts. Thus, either type of catalyst can be used if hot combustion air is used as the decomposition medium, but tubes or a parallel-path catalyst must be used if flue gas is used as the decomposition medium.

It has been found that a catalyst comprising a mixture of $V_2O_5$, $K_2O$ and $SO_3$ on an $SiO_2$ support accomplishes the desired chemical effect, and is durable enough in either the flue gas or hot combustion air atmosphere. Thus, a catalyst comprising a mixture of $V_2O_5$, $K_2O$, and $SO_3$ on an $SiO_2$ support is the preferred catalytic system according to the present invention. However, other catalytic mixtures capable of producing the desired chemical effect may be used.

After passing through the catalytic oxidation chamber, the $SO_3$ decomposition product and any other remaining decomposition products in the flue gas or hot combustion air are transported through a heated or thermally insulated duct to a distribution manifold and distributed into the main stream of flue gas exiting from the air preheater at a point upstream from the electrostatic precipitator.

The temperature of the slipstream of flue gas or air entering the decomposition chamber should be in the range of from about 600° F. to 1000° F. It is particularly preferred that the flue gas temperature be in the range of about 700° F. to 900° F. In this temperature range, with reaction times of 2 seconds or less, there is adequate conversion of the conditioning agent to the key decomposition product, sulfur trioxide.

The preferred aqueous solution of ammonium sulfate contains from about 5 to 45% by weight ammonium sulfate and the preferred aqueous solution of ammonium bisulfate contains from about 5 to 80% by weight ammonium bisulfate. Preferably, the aqueous solution of ammonium sulfate or ammonium bisulfate is sprayed into the chamber at a rate sufficient to produce a sulfur trioxide concentration in the range of from about 250 to 2500 ppm by volume. The sulfur trioxide should be distributed into the main stream of flue gas to achieve a preferred concentration in the range of from about 2.5 to 25 ppm by volume.

The present invention is applicable to any situation in which the operation of a cold side precipitator is being adversely affected by the high resistivity of the fly ash it is collecting. In particular, the present invention will be useful in situations where a utility switches from high sulfur coal to low-sulfur coal in order to comply with sulfur oxide emissions limitations. Low sulfur coals generally produce fly ash that is characterized by high resistivity at cold side precipitator temperatures.

The present invention will also be useful (1) in circumstances where there is a switch in coal supplies and the new coal produces fly ash with higher resistivity; (2) in circumstances where the performance of an existing precipitator must be optimized, by lowering the resistivity of the fly ash, in order to meet new lower particulate emissions regulations; and (3) in circumstances where a new unit is scheduled to burn a low sulfur coal, because the cost of the new precipitator can be reduced by designing the precipitator to collect fly ash with a lower resistivity rather than a higher resistivity.

A detailed description of the process with reference to the drawings follows.

Figure 1:
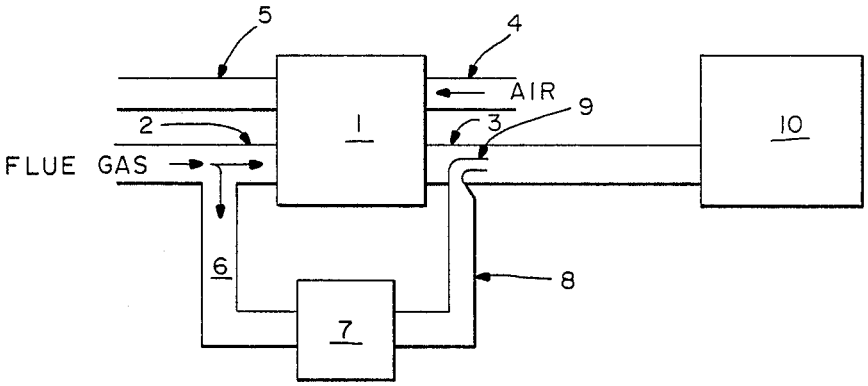
FIG. 1 represents the method of decomposing ammonium sulfate or ammonium bisulfate with a slipstream of hot flue gas.

Referring to FIG. 1, there is illustrated one preferred embodiment of the present invention wherein a slipstream of flue gas is used to decompose the ammonium sulfate or bisulfate. An air preheater 1 with an inlet duct 2 on the hot side and an outlet duct 3 on the cold side for flue gas is shown, as well as an inlet duct 4 on the cold side and an outlet duct 5 on the hot side for combustion air. A slipstream of flue gas 6 is drawn from the main flue gas stream on the hot side of the air preheater and then drawn through the decomposition chamber 7.

Figure 2:
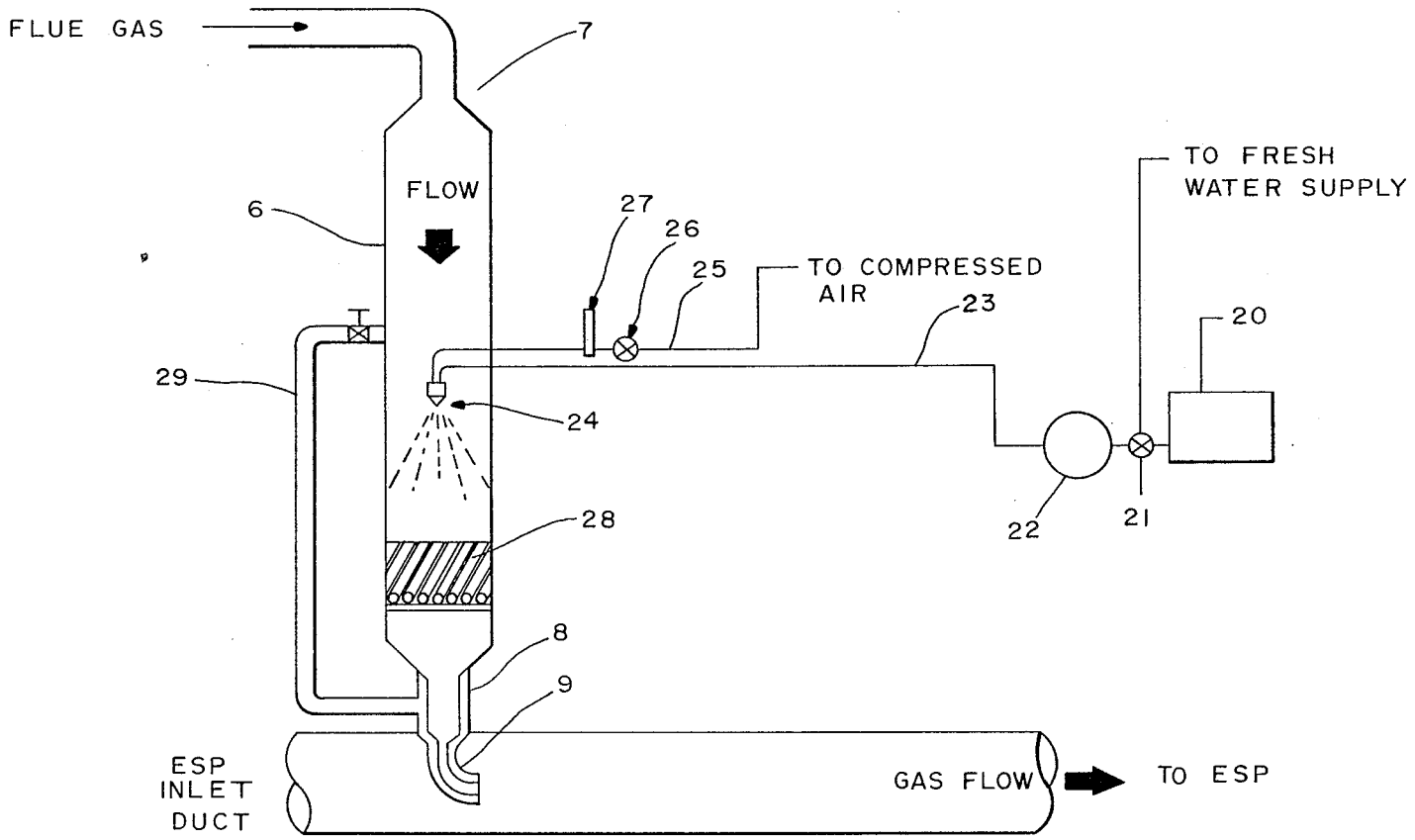
FIG. 2 represents the ammonium sulfate or bisulfate decomposer system where a slipstream of flue gas is used to decompose the ammonium sulfate or bisulfate.

The decomposition chamber 7 is shown in detail in FIG. 2. An aqueous solution of ammonium sulfate or bisulfate is contained in tank 20. Fresh water is supplied as needed at inlet 21. Pump 22 delivers the ammonium sulfate or bisulfate solution through line 23 to air atomizing spray nozzle 24. Compressed air is delivered through line 25 to air regulator 26, rotameter 27 and spray nozzle 24.

Returning to FIG. 1, a slipstream of flue gas taken from outlet 2 at the hot side of air preheater 1, flows through insulated duct 6 into the decomposition chamber 7. The ammonium sulfate or bisulfate solution (the conditioning agent) is sprayed into decomposition chamber 7 into the slipstream of the flue gas where the thermal decomposition of the conditioning agent takes place. The flue gas flowing through chamber 7 is maintained at a temperature in the range of from about 600° F. to 1000° F., and is at approximately atmospheric pressure. The hot flue gas in chamber 7 decomposes the conditioning agent. The decomposition products—gaseous ammonia, water, and sulfur trioxide—are then transported through the ammonia oxidation chamber 28 (FIG. 2). Preferably, the decomposition chamber is disposed vertically so that the flue gas and decomposition products flow downwardly through the ammonia oxidation chamber 28 as shown in FIG. 2. The downward flow of the flue gas helps to prevent the fly ash in the flue gas from collecting in the catalyst bed in the oxidation chamber 28.

The oxidation chamber 28 contains a catalyst capable of producing the desired oxidation of $NH_3$ with minimal reduction in the concentration of $SO_3$. A preferred catalyst, comprising a mixture of $V_2O_5$, $K_2O$, and $SO_3$ on an $SiO_2$ support, produces the desired chemical effect. Catalysts of this type are commercially available in either solid or open pellet form from Monsanto designated LP-120, LP-110, and T-210, from United Catalysts designated C-116, and from BASF Wyandotte designated 04-110.

The pellet form is less effective when flue gas serves as the decomposition gas as shown in FIGS. 1 and 2, and thus the preferred catalyst in that case comprises a mixture of $V_2O_5$, $K_2O$, and $SO_3$ on an $SiO_2$ or $TiO_2$ support in a hollow tube configuration as shown in FIG. 6 or in a parallel path or honeycomb arrangement as shown in FIG. 7.

The catalyst tubes shown in FIG. 6 have an internal diameter of about 0.8 inch, an outer diameter of about 1.2 inches and are about 24 inches long. All of the tubes are disposed vertically in the oxidation chamber as shown in illustration A of FIG. 6, so that the flue gas and decomposition products flow downwardly through the tubes.

The decomposition chamber can be arranged so that the flue gas flows horizontally or upwardly through the catalyst tubes but a downward or upward flow is preferred because it helps to prevent fly ash from collecting in the catalyst tubes and thereby plugging the pathways.

In catalyst honeycomb shown in FIG. 7, the catalytic material is applied to a base material of $SiO_2$ or $TiO_2$ having individual channels 0.25 inch square by 24 inches, which are formed by extrusion. The honeycomb catalyst is also, preferably, placed in the decomposition chamber so that the individual channels are disposed vertically enabling the flue gas to flow downward or upward through the channels to prevent fly ash collection and plugging of the channels.

The catalyst pellets shown in FIG. 5 are short hollow rods about 0.50 inch long with a 0.50 inch outer diameter, and a 0.15 inch inner diameter. Preferably, the catalyst pellets are placed on a screen and disposed in the decomposition chamber so that the flue gas flows downwardly or upwardly through the catalyst bed.

Returning to the description of the decomposition chamber in FIG. 2, a sheath air duct 29 serves the purpose of insulating the gas containing the decomposition products from the cooler surroundings. This sheath air duct may optionally be replaced with a jacket of insulating material.

After the flue gas flows through the catalyst in the oxidation chamber 28, the flue gas containing the $SO_3$ decomposition product and any remaining $NH_3$ or other decomposition products is transported through thermally insulated duct 8, where it is distributed through the distribution manifold 9 into the main stream of fine gas exiting from the air preheater at a point downstream from the air preheater 1 and upstream from the electrostatic precipitator 10, as shown in FIG. 1.

Figure 3:
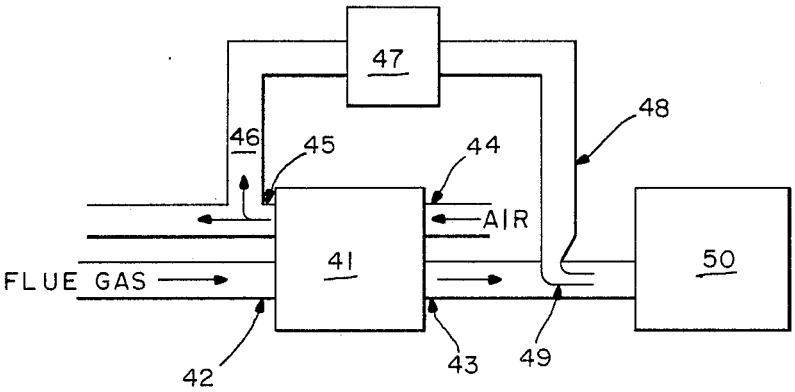
FIG. 3 represents the method of decomposing ammonium sulfate or ammonium bisulfate with a slipstream of hot combustion air.

Referring to FIG. 3, there is shown another preferred embodiment of the process of the present invention whereby a slipstream of hot combustion air is used to decompose the conditioning agent. An air preheater 41 with an inlet duct 42 on the hot side and an outlet duct 43 on the cold side for flue gas, as well as an inlet duct 44 on the cold side and an outlet duct 45 on the hot side for combustion air. A slipstream of the combustion air 46 is drawn from the main combustion air stream on the hot side of the air preheater 41 and then drawn through decomposition chamber 47.

Figure 4:
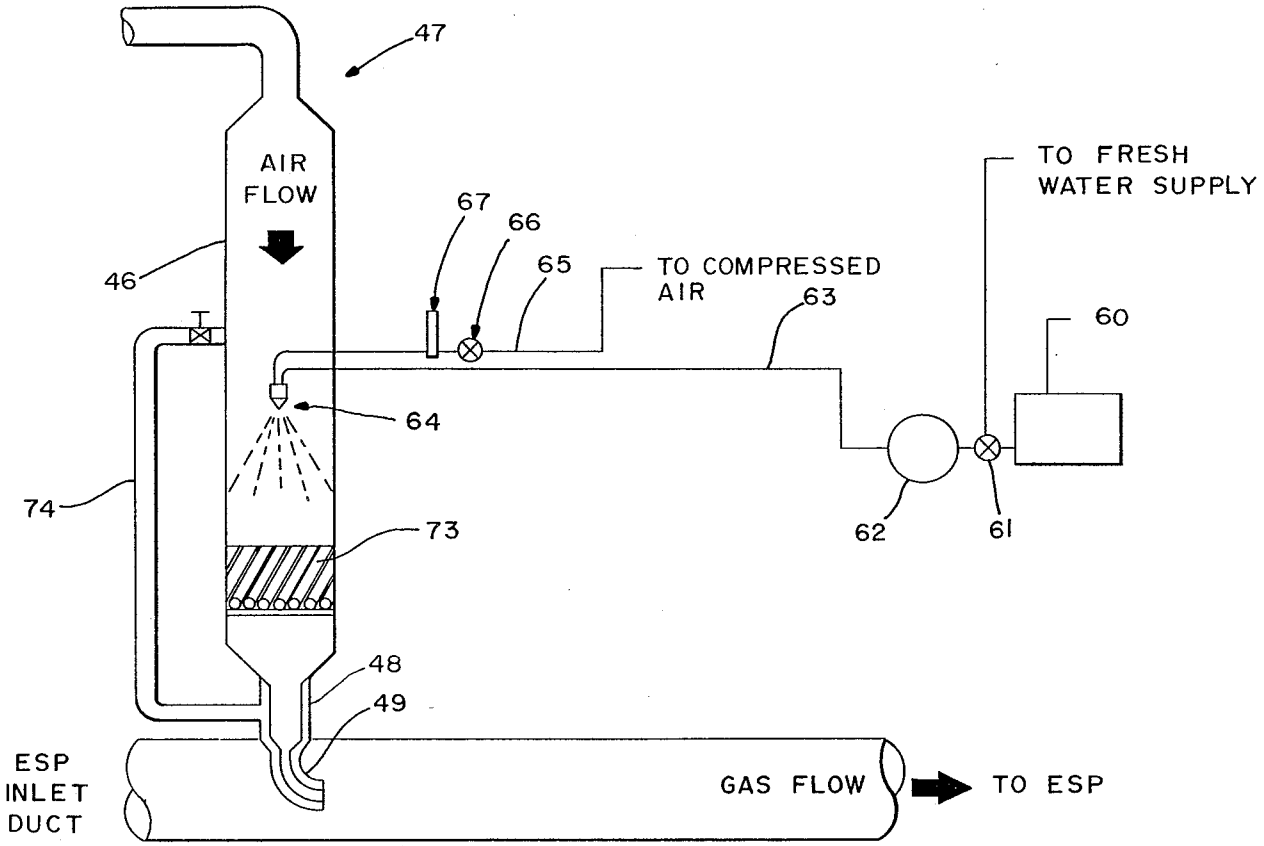
FIG. 4 represents the ammonium sulfate or bisulfate decomposer system where hot combustion air is used to decompose the ammonium sulfate or bisulfate.

The decomposition chamber 47 is shown in detail in FIG. 4. An aqueous solution of ammonium sulfate or bisulfate is contained in tank 60. Fresh water is supplied as needed at inlet 61. Pump 62 delivers the ammonium sulfate or bisulfate solution through line 63 to air atomizing spray nozzle 64. Compressed air is delivered through line 65 to air regulator 66, rotameter 67 and spray nozzle 64.

Returning to FIG. 3, a slipstream of hot combustion air taken from the outlet 45 at the hot side of the air preheater 41 and passes into duct 46 of decomposition chamber 47. The ammonium sulfate or bisulfate solution (the conditioning agent) is sprayed into decomposition chamber 47 into the slipstream of hot combustion air, where the thermal decomposition of the conditioning agent takes place. The hot air flowing through the chamber 47 is maintained at a temperature in the range of from about 600° F. to 1000° F., and is at approximately atmospheric pressure. The hot air in chamber 47 decomposes the conditioning agent.

The decomposition products—gaseous ammonia, water, and sulfur trioxide—are then transported through the ammonia oxidation chamber 73 (FIG. 4). The decomposition chamber is disposed vertically so that the hot air and decomposition products flow downwardly through the ammonia oxidation chamber 73 as shown in FIG. 4. While downward flow is the preferred arrangement when flue gas is used to decompose the conditioning agent because of the fly ash collection problem described above, there is no problem with fly ash collection when hot combustion air is used and thus no preferred arrangement of the decomposition or oxidation chamber. It can be horizontal or vertical, the gas can flow either downwardly, upwardly, or horizontally through the catalyst.

The same catalysts described above can be used in the oxidation chamber 73. The three physical forms of catalyst described above, pellets, hollow tubes, and honeycomb are equally effective in this embodiment of the process of the present invention because there is no problem with fly ash collecting in and plugging the catalyst.

Returning to FIG. 4, after the hot combustion air and decomposition products flow through the catalyst in the oxidation chamber 73, the hot combustion air containing the $SO_3$ decomposition product and any other remaining decomposition products is transported through thermally insulated duct 48, where it is distributed through the distribution manifold 49 into the main stream of flue gas exiting from the air preheater at a point downstream from the air preheater 41 and upstream from the electrostatic precipitator 50, as shown in FIG. 3. The following examples demonstrate the effectiveness of the process of the present invention using the three types of catalysts described above.

EXAMPLE 1

A porous bed of partially fragmented pellets of Monsanto LP-120 catalyst was prepared in a laboratory reactor to provide a catalyst-$NH_3$ contact time of 0.1 sec. A substantial body of data obtained with this arrangement, when $NH_3$ and $SO_3$ were simultaneously present in heated air, can be summarized as follows:

| | 700° F. | 800° F. |
|---|---|---|
| Percentage of $NH_3$ converted to | | |
| all products | 87–98% | 97–100 |
| $N_2O$, NO, $NO_2$ | 9–11% | 30–31% |
| $N_2$ | 78–87% | ca. 70% |
| Percentage of $SO_3$ converted to | | |
| $SO_2$ | 19–33% | 6–8% |

The above data suggests that a compromise must be made between raising the temperature to lower the unwanted conversion of $SO_3$ to $SO_2$ or lowering the temperature to minimize the formation of nitrogen oxides. It should be noted, however, that while the conversion of ammonia to oxides of nitrogen is not desirable because it would add a small quantity of these oxides to the flue gas (the quantity would be so small that it could not be accurately measured), the presence of these oxides does not diminish the conditioning effect of $SO_3$.

Other data with $NH_3$ in simulated flue gas (a gas composed of $SO_2$, $H_2O$, $O_2$ and $N_2$ in the proper proportions but containing no fly ash) indicate that the percentage of $NH_3$ oxidized was moderately lowered: from 98 to 75% at 700° F. or from 100 to 97% at 800° F.

In a pilot-scale reactor, the pellets of Monsanto LP-120 were packed intact in a bed 12 inches deep, as portrayed in FIG. 5, to give a residence time of 0.1 sec for a stream of air containing $NH_3$ and $SO_3$. The percentage of $NH_3$ oxidized at various temperatures was as follows:

| | 700° F. | 750° F. | 830° F. |
|---|---|---|---|
| Air | 67% | 77% | 97% |

No pilot-scale test of the Monsanto catalyst in flue gas was made, because of the presence of fly ash that would have accumulated in the bed and obstructed gas flow.

The practical benefit of the process was demonstrated in the pilot test by mixing approximately 2 volume parts of the catalytic effluent in air with 100 volume parts of flue gas and determining the effect on the electrical resistivity of the fly ash entrained therein. The baseline resistivity of unconditioned ash was around $5\times10^{11}$ ohm-cm. This value was not appreciably reduced when both $NH_3$ and $SO_3$, intact as products of the decomposition of $(NH_4)_2SO_4$, were added to the flue gas. However, the resistivity was lowered to about $1\times10^{10}$ ohm-cm when the $NH_3$ had been catalytically removed and only the $SO_3$ remained, providing 10 to 15 ppm of $SO_3$ in the flue gas.

EXAMPLE 2

A hollow tube catalyst comprising a homogeneous mixture of $V_2O_5$ and $TiO_2$ was obtained from Kawasaki for a previous study as a de$NO_x$ catalyst. For evaluation as an $NH_3$ oxidation catalyst, a tube was fragmented and the pieces packed in a porous bed; the depth of the bed provided a contact time of 0.1 sec at either 700° F. or 800° F. with the $NH_3$ and $SO_3$ in either air or simulated flue gas. The simulated flue gas was a mixture of $SO_2$, $H_2O$, $O_2$ and $N_2$ in the proper proportions but containing no fly ash. The percentage of $NH_3$ oxidation was as follows:

| | 700° F. | 800° F. |
|---|---|---|
| Air | 14% | 56% |
| Flue gas | 0 | 34% |

Under these conditions, which provided relatively incomplete oxidation of $NH_3$, apparently all of the $NH_3$ was converted to $N_2$; no evidence of $NO_x$ conversion product was detected. The data indicate that there may have been a loss of 20 to 25% of the $SO_3$ owing to the reduction of $SO_3$ to $SO_2$.

In the pilot-scale reactor, the hollow tubes remained intact and provided a contact time of about 0.5 sec, with $NH_3$ and $SO_3$ in either air or actual flue gas (including fly ash) at temperature of 820° F. to 850° F. Results on the percentage of $NH_3$ oxidized during those tests are as follows:

| | 820° F. | 850° F. |
|---|---|---|
| Air | 73% | — |
| Flue gas | — | 63% |

EXAMPLE 3

A honeycomb substrate provided by Corning consisting of a homogeneous mixture of 91% $TiO_2$ and 9% $SiO_2$ was impregnated with an aqueous solution of $K_2SO_4$, $VOSO_4$, and $H_2SO_4$. Following impregnation, the honeycomb was calcined at 800° F. to convert the added chemicals to a catalyst system of $K_2O$, $V_2O_5$, and $SO_3$. The catalyst was then placed in a laboratory reactor and swept with an $NH_3$-containing gas stream simulating flue gas in composition. The simulated flue gas was a mixture of $SO_2$, $H_2O$, $O_2$ and $N_2$ in the proper proportions but containing no fly ash. The contact time between catalyst and $NH_3$ was about 0.2 sec. The percentage of $NH_3$ oxidized was as follows:

| | 700° F. | 800° F. |
|---|---|---|
| Flue gas | 22% | 99% |

Approximately half of the $NH_3$ was converted to $N_2$ and half to $NO_x$. No net loss of $SO_3$ occurred; instead, the concentration of $SO_3$ increased as the result of partial oxidation of $SO_2$ in the simulated flue gas.

What is claimed is:

1. A method for conditioning flue gas containing suspended fly ash, comprising the steps of:

(a) diverting a slipstream of flue gas from a main flue gas stream at a point upstream from an air preheater located directly upstream of an electrostatic precipitator where the temperature of said main flue gas stream is in the range of about 700° F. to 900° F., said diverted stream thereby having a temperature in the range of from about 700° F. to 900° F.;

(b) introducing an aqueous solution of ammonium sulfate or ammonium bisulfate into said diverted flue gas slipstream thereby effecting thermal decomposition of said ammonium sulfate or bisulfate into its gaseous thermal decomposition products which include sulfur trioxide and ammonia;

(c) flowing said gaseous thermal decomposition products through a catalyst capable of oxidizing $NH_3$ with $O_2$ to produce $N_2$ and $H_2O$ and suppressing the reaction whereby $NH_3$ and $SO_3$ interact by an oxidation-reduction process to produce $N_2$, $SO_2$ and $H_2O$;

(d) then returning said diverted flue gas slipstream to said main flue gas stream at a point between said air preheater and said electrostatic precipitator thereby distributing said gaseous thermal decomposition products into said main flue gas stream flowing between said air preheater and said electrostatic precipitator.

2. A method according to claim 1, wherein said slipstream of flue gas containing said thermal decomposition products is directed to flow downwardly through said catalyst to prevent collection of fly ash in said catalyst.

3. A method for conditioning flue gas containing suspended fly ash, comprising the steps of:

(a) diverting a slipstream of combustion air from a main combustion air stream exiting the hot side of an air preheater after having passed through said preheater where the temperature of said main combustion air stream is in the range of about 700° F. to 900° F., said diverted combustion air slipstream thereby having a temperature in the range of from about 700° F. to 900° F.;

(b) introducing an aqueous solution of ammonium sulfate or ammonium bisulfate into said diverted slipstream of combustion air, thereby effecting thermal decomposition of said ammonium sulfate or bisulfate into its gaseous thermal decomposition products which includes sulfur trioxide and ammonia;

(c) flowing said gaseous thermal decomposition products through a catalyst capable of oxidizing $NH_3$ with $O_2$ to produce $N_2$ and $H_2O$ and suppressing other reactions whereby $NH_3$ and $SO_3$ interact by an oxidation-reduction process to produce $N_2$, $SO_2$ and $H_2O$; and (d) introducing said diverted slipstream of combustion air into a main flue gas stream at a point between said air preheater and an electrostatic precipitator located directly downstream of said air preheater, thereby distributing said gaseous thermal decomposition products into said main flue gas stream between said air preheater and said electrostatic precipitator.

4. A method according to claim 1 or 3, wherein said decomposition products from steps (b) and (c) are transported through a thermally insulated duct.

5. A method according to claim 1 or 3, wherein said decomposition products are distributed into said main flue gas stream through a distribution manifold.

6. A method according to claim 1 or 3, wherein said aqueous solution of ammonium sulfate contains from about 5 to 45% by weight of ammonium sulfate.

7. A method according to claim 1 or 3, wherein said aqueous solution of ammonium bisulfate contains from about 5 to 80% by weight of ammonium bisulfate.

8. A method according to claim 1 or 3, wherein said aqueous salt solution is sprayed at a rate sufficient to produce a sulfur trioxide concentration from about 250 to 2500 ppm by volume and said sulfur trioxide is then distributed into the main stream of flue gas to produce a concentration therein from about 2.5 to 25 ppm by volume.

9. A method according to claim 1 or 3, wherein said catalyst comprises a mixture of $V_2O_5$, $K_2O$, and $SO_3$ on an $SiO_2$ support.

10. A method according to claim 1 or 3, wherein said catalyst is in the form of pellets.

11. A method according to claim 1 or 3, wherein said catalyst is in the form of hollow tubes.

12. A method according to claim 1 or 3, wherein said catalyst is applied to a parallel-passage support having individual channels formed in a solid piece of the substrate to which said catalyst is applied.

* * * * *